US009581374B2

(12) United States Patent
Kuhn et al.

(10) Patent No.: US 9,581,374 B2
(45) Date of Patent: Feb. 28, 2017

(54) METHOD FOR PRECONDITIONING LATENT HEAT STORAGE ELEMENTS

(71) Applicant: VA-Q-TEC AG, Wurzburg (DE)

(72) Inventors: Joachim Kuhn, Wurzburg (DE); Fabian Eschenbach, Rottendorf (DE); Tobias Bock, Wurzburg (DE)

(73) Assignee: VA-Q-TEC AG, Wurzburg (DE)

( * ) Notice: Subject to any disclaimer, the term of this patent is extended or adjusted under 35 U.S.C. 154(b) by 0 days.

(21) Appl. No.: 14/442,962

(22) PCT Filed: Dec. 9, 2013

(86) PCT No.: PCT/EP2013/003706

§ 371 (c)(1),
(2) Date: May 14, 2015

(87) PCT Pub. No.: WO2014/094995

PCT Pub. Date: Jun. 26, 2014

(65) Prior Publication Data

US 2015/0292787 A1 Oct. 15, 2015

(30) Foreign Application Priority Data

Dec. 18, 2012 (DE) ..... 10 2012 024 695
Feb. 15, 2013 (DE) ..... 10 2013 002 555

(51) Int. Cl.
*F25D 3/00* (2006.01)
*B65D 81/38* (2006.01)
(Continued)

(52) U.S. Cl.
CPC ..... *F25D 3/08* (2013.01); *F25D 3/00* (2013.01); *F25D 3/02* (2013.01); *F25D 3/06* (2013.01);
(Continued)

(58) Field of Classification Search
CPC .. G06Q 50/28; F25B 3/06; F25B 3/08; B65D 81/38; F25D 2303/08;
(Continued)

(56) References Cited

U.S. PATENT DOCUMENTS 4,528,439 A 7/1985 Marney, Jr. et al.
6,482,332 B1 11/2002 Malach
(Continued)

FOREIGN PATENT DOCUMENTS

DE 10058566 C2 10/2002
DE 10322764 A1 12/2004
(Continued)

OTHER PUBLICATIONS

International Search Report for PCT/EP2013/003706 dated Jun. 3, 2014.
(Continued)

*Primary Examiner* — Ryan J Walters
*Assistant Examiner* — Erik Mendoza-Wilkenfe
(74) *Attorney, Agent, or Firm* — Andrus Intellectual Property Law, LLP

(57) ABSTRACT

A method is for preconditioning at least one latent heat storage element, which is arranged in a thermally insulated, closed container having a space for accommodating goods to be transported. The latent heat storage element has a target temperature preferably slightly in excess of 0 DEG C. In such an arrangement, it is particularly practical for the accommodation space in the container to be filled with a certain amount of a coolant, particularly ice, and for the container to be closed, and therefore the latent heat storage element located in the container is cooled to the target temperature.

9 Claims, 2 Drawing Sheets

(51) Int. Cl.

| | |
|---|---|
| ***F25D 11/00*** | (2006.01) |
| ***F25D 3/08*** | (2006.01) |
| ***F25D 3/02*** | (2006.01) |
| ***F25D 3/06*** | (2006.01) |
| ***F25D 29/00*** | (2006.01) |

(52) U.S. Cl.
CPC ..... *F25D 29/003* (2013.01); *B65D 81/38* (2013.01); *F25D 11/00* (2013.01); *F25D 2201/14* (2013.01); *F25D 2303/08* (2013.01); *F25D 2303/082* (2013.01); *F25D 2400/02* (2013.01); *F25D 2500/04* (2013.01); *F25D 2600/04* (2013.01)

(58) Field of Classification Search
CPC ..... F25D 2303/081; F25D 3/00; F25D 3/02; F25D 11/00; F25D 11/003
See application file for complete search history.

(56) References Cited

U.S. PATENT DOCUMENTS 7,500,593 B2 * 3/2009 Mayer ..... B65D 81/3816 220/592.2
7,849,708 B2 * 12/2010 Goncharko ..... F25D 3/06 62/371
2008/0099492 A1 * 5/2008 Mayer ..... B65D 81/3816 220/592.2
2008/0276643 A1 * 11/2008 Heroux ..... A01N 1/02 62/457.2
2011/0067852 A1 3/2011 Farrar
2012/0197810 A1 * 8/2012 Haarmann ..... G06Q 10/0832 705/302
2014/0054297 A1 * 2/2014 Patstone ..... F25D 3/08 220/592.01

FOREIGN PATENT DOCUMENTS

| | | | |
|---|---|---|---|
| DE | 202006004344 | U1 | 6/2006 |
| DE | 102006032435 | A1 | 1/2008 |
| DE | 102012006743 | A1 | 10/2013 |
| WO | 9717580 | A1 | 5/1997 |
| WO | 2004104498 | A1 | 12/2004 |

OTHER PUBLICATIONS

"Latentwarmespeicher", BINE Information Services, Theme Info IV/2002.
Brochure "va-Q-tec Packaging Portfolio", Jan. 2011.

* cited by examiner

METHOD FOR PRECONDITIONING LATENT HEAT STORAGE ELEMENTS

CROSS-REFERENCE TO BELATED APPLICATIONS

This application is the U.S. national stage application of International Application PCT/EP2013/003706, filed Dec. 9, 2013, which international application was published on Jun. 26, 2014, as International Publication WO 2014/094995 in the German language. The international application is incorporated herein by reference, in entirety. The international application claims priority to German Patent Application No, 102012024695.1, filed Dec. 18, 2012 and German Patent Application No. 102013002555.9, filed Feb. 15, 2013, which are incorporated herein by reference, in entirety.

FIELD

The invention relates to a method for preconditioning at least one latent heat storage element.

BACKGROUND

For the storage of heat in a storage material suitable for this purpose, the temperature of said storage material is normally increased. This form of heat storage is called sensible heat storage.

Whenever, in a material suitable for this purpose, a phase transition takes place, for example the transition from the solid into the liquid phase (or vice versa), the relationship between the temperature of the storage material and the heat absorbed (or output) by the storage material is no longer linear. In the event of a transition from solid to liquid, the heat storage material begins to melt when the temperature of the phase transition is reached. The storage material maintains this temperature by supplying heat until the storage material has completely melted. Only then does an increase in the temperature occur again upon further absorption of heat.

Since virtually no increase in the temperature occurs for a relatively long time despite the supply of neat, this is called latent heat. In the case, for example, of the typical phase transition solid/liquid, the latent neat is identical to the melting heat or crystallization heat of the storage material.

A latent heat storage material has the great advantage that it can be used to store relatively large quantities of heat within a small temperature range. Since the phase transition takes place over a certain period of time at a substantially constant temperature, temperature fluctuations can be compensated for and temperature peaks avoided.

Latent heat storage materials are known in various forms. In English terminology, these materials are also called PCM materials (phase change materials).

At a target temperature (temperature of the phase transition) of approximately 0° C., water with different additives can be used as the latent heat storage material. For cold storage below 0° C., use is made of suitably prepared salt solutions.

In the region just above 0° C., other materials, for example those on the basis of paraffins, are more suitable.

In particular, as background, reference is made to the overview article from BIKE Information Service "Themeninfo IV/02 aus dem Jahre 2002 [Theme info IV/02 from 2002]", (FIZ Karlsruhe, project code 032980A-D, which is retrievable at www.bine.info, keyword: "Latentwärmespeicher" [Latent heat storage]). For the general background of latent heat storage materials and the use possibilities thereof, reference is hereby made by reference to the content of this citation.

A latent heat storage element according to the present invention is a latent heat storage material in a closed covering which is optionally also provided with a pressure-equalizing valve. A macro-encapsulated PCM material is also mentioned in this respect. The covering is frequently made from plastic. The basic structure is known, for example, from what are referred to as cooling batteries.

There are, in the meantime, latent heat storage elements of the type under discussion for an abundance of target temperatures, in particular also from the applicant (brochure "va-Q-tec Packaging Portfolio, January 2011"). Latent heat storage elements for target temperatures of 37° C., 22° C., 4° C., 0° C., −19° C., −21° C. and −32° C. are found there. Other providers have comparable latent heat storage elements in their sales range, sometimes also for different target temperatures.

Latent heat storage elements of the type under discussion are used in a particular field of use in thermally insulated containers, in particular for transport purposes. For example, this is true of the transport of temperature-sensitive items, such as pharmaceuticals, biotechnological products, transplant items or blood reserves. In this field of use, the optimum transport and storage temperature which absolutely has to be maintained is, for example, 2° C. to 8° C. The products are frequently only stable at all within a very narrow temperature range. The products therefore have to be transported and stored within this temperature range. In addition, frequently such products, which are highly sensitive with regard to the transport temperature, must not ever freeze. Temperatures below 0° C. must then be reliably avoided. The target temperature thus has to be reliably reached and maintained with comparatively little deviation.

The temperature which is maintained with little deviation by the latent heat storage element during the phase transition and which results from the used latent heat storage material of the latent heat storage element is designated below as the target temperature.

The present case involves preconditioning at least one latent heat storage element in a thermally insulated, closed container having a receiving space for items to be transported and in which the latent storage element has a target temperature of preferably somewhat above 0° C.

Prior art in this regard (WO 2004/104498 A2) relates to a thermally insulated container, in particular for transport purposes, wherein the container is insulated against heat exchange with the ambient atmosphere by vacuum insulation panels, and has at least one latent heat storage element of the type under discussion in the interior. To this extent, reference is made to the disclosure of the previously published document from which many aspects of the use of latent heat storage elements in transport containers can be gathered.

The technology of vacuum insulation panels has basically already been known for a relatively long time, but is being continuously perfected in terms of production and material. For vacuum insulation panels, reference may be made in principle to this extent to DE 100 58 566 C2 belonging to the applicant of the present application. Vacuum insulation panels of this type are currently the most efficient thermal insulation elements.

SUMMARY

The present case now relates to a method for preconditioning latent heat storage elements which are arrangeable or are arranged in a container.

So that the latent heat storage element can have its effect during use in the transport container, it must previously be cooled to a temperature lying below the target temperature. For example, a latent heat storage material which melts between 3° C. and 5° C. has to be cooled as far as possible to a temperature close to this value. At best, a pre-conditioning to the lower limit of the tolerance range of the target temperature, that is, for example, to approximately 3° C. here, therefore takes place (in the event of a positive target temperature) such that as great a quantity of heat as possible can still be absorbed during the use in the thermally insulated transport container. This is namely equivalent to the tact that the target temperature in the transport container can be maintained relatively precisely over a comparatively long period of time.

For the pre-conditioning of latent heat storage elements, a pre-cooling temperature which is as precise as possible and which, as explained, is intended to be as close as possible to or within the tolerance range of the target temperature of the latent heat storage material used is therefore required.

For the pre-conditioning of latent heat storage elements of this type, the latter frequently are introduced into a cooling room. A cooling room normally does not have an especially precise temperature setting. For example, a typical cooling room temperature is 5° C. with a tolerance range of +/−2° C., i.e. somewhere between 3° C. and 7° C. This is insufficient for intended uses, such as in the sphere of biotechnological products, etc., as stated above. If the requirements for transport or for other handling of temperature-sensitive items are to be achieved, complicated, pre-conditioning methods or particularly precisely controllable cooling devices have to be used. Complicated pre-conditioning methods of this type are prone to error, it is also not possible for said methods to be carried out in ail countries, in particular not in less developed countries.

A less complicated method for preconditioning latent heat storage elements has been disclosed more recently (DE 20 2006 004 344 U1). In this method, before a sample container is stored in the receiving space, the latent heat storage element is energetically charged, i.e. frozen. This is undertaken here by a coolant, the temperature of which lies below the freezing temperature of the latent heat storage element, being placed into the receiving space of the container. The coolant is left there until the latent heat storage element has completely frozen through and solidified. A visual check is required for this. That is, a person has to open the receiving space of the container from time to time, look in and determine whether the latent heat storage element makes the impression of being frozen through and solidified.

The invention is based on the problem of specifying a method for preconditioning at least one latent heat storage element in a container, which method simply and reliably ensures that the latent, heat storage element is reliably preconditioned to close to the target temperature thereof for the use thereof in the container.

The previously presented problem is solved in a first variant by the method as claimed in claim 1. In an alternative, the previously presented problem is solved by a method as claimed in claim 3. Preferred refinements and developments are the subject matter of the respective dependent, claims.

In the claims, the singular is used for the latent heat storage element. However, the reference to "at least one latent heat storage element" makes it clear that the present method is also usable whenever a plurality of latent neat storage elements are preconditioned simultaneously.

The method according to the invention relates specifically to the preconditioning of a latent heat storage element with a defined target temperature. A sphere of particular interest is present in the case of latent heat storage elements having a target temperature of somewhat more than 0° C. This target temperature is typical for the transport of the above-discussed, temperature-sensitive items, such as pharmaceuticals, biotechnological products, transplant items or blood reserves. For this sphere, target temperatures of between 2° C. and 8° C. are typical, as already explained above.

According to the invention, the container itself is used with the receiving space thereof in order to condition the at least one latent heat storage element in the container. This is undertaken by using an appropriate coolant.

Very particularly preferably, the preconditioning is undertaken with an agent which is available worldwide, namely with water ice. Dry ice is also a good preconditioning agent.

It is particularly preferred, in particular in the case of water ice or dry ice, for the coolant to be placed into the receiving space of the container in a separate, closed vessel, in particular a plastic bag.

The invention is explained below using the specific, preferred exemplary embodiment of wafer ice as the coolant. However, this does not exclude this method also being able to be realized with other appropriate coolants, that is coolants reaching the temperature range of interest. Whenever water ice is discussed below as a particularly preferred exemplary embodiment, this should therefore not be understood as limiting. However, water ice is the particularly preferred option because of being a particularly expediently usable variant of the coolant to be used which is available everywhere.

A precondition is that at least one latent heat storage element is already located in the container. According to the invention, water ice is first of all placed into the receiving space which is used later, after the preconditioning of the latent heat storage element, for the transport of the items in the container. The container is then closed such that the excellent thermal insulation can do its job. The container is very well thermally insulated by means of, in particular, vacuum insulation panels, and can ensure a temperature equalization with little thermal losses. The water ice cools the latent heat storage element to the target temperature thereof. A considerable scope of fluctuation is permissible here for the mass of water ice because of the high thermal capacity of the latent heat storage element within the range of the target temperature thereof (phase transition liquid/solid).

After the preconditioning of the latent heat storage element, the interior of the container is at the temperature which the container has to have in order to transport the temperature-sensitive items. The water or water ice/water mixture is removed from the receiving space (i.e. is simply poured out). The receiving space is wiped out and dried and then the items to be transported are placed therein. The latent heat storage element ensures the desired constant temperature just above 0° C. in the case of the example. Protection against freezing is therefore automatically ensured.

Alternatively, it is also possible for the coolant to continue to remain in the receiving space after the target temperature of the latent heat storage element is reached. This is possible in particular whenever the coolant is located in a separate, closed vessel. In this case, the latent heat storage element merely acts in such a manner that the temperature in the container overall is set somewhat above the temperature of the coolant. In the case of water ice, protection against freezing is thereby also ensured.

In the first variant of the method according to the invention, the mass of coolant, in particular therefore of water ice, which has to be placed into the receiving space in order to allow the latent heat storage element to reach the target temperature thereof, is calculated in advance. The algorithm of the calculation step is thus targeted on the precisely correct mass of coolant, in particular therefore of water ice.

The alternative as claimed in claim 3 takes a different path. Coolant, in particular therefore water ice, is placed here in an excess amount into the receiving space. The calculation algorithm here calculates the time required for reaching the target temperature of the latent heat storage element. The user has to wait for a defined time known to the user in order to achieve the appropriate preconditioning of the latent heat storage element. After the period of time is reached, the receiving space is again emptied, wiped out and can then be filled with the items to be transported. There is also the alternative here that coolant can be left in the receiving space under certain boundary conditions.

The method according to the invention is particularly suitable for the transport of organs and blood reserves in which, for logistical reasons, water ice is chiefly rapidly available as a cooling medium, but freezing of the item being transported has to be avoided under all circumstances.

For the further refinement of the method according to the invention, there are also different influencing variables which can be used in the calculation step in order further to optimize the result. Before the coolant, in particular the water ice, is placed into the container and before the calculation step, the initial temperature of the latent heat storage element is expediently determined. Furthermore, it is expedient for the temperature of the coolant to be used, in particular the water ice, to be determined before the calculation step and to be used in the subsequent calculation step.

Finally, it is recommended to insulate the container with the aid of the vacuum insulation panels explained at the beginning. This is particularly effective.

Finally, it is also possible to arrange the items to be transported together with the coolant in the receiving space. The latent heat storage element also acts in this case in such a manner that the temperature in the container as a whole is set somewhat above the temperature of the coolant. In particular, in the case of the particular example of water ice as coolant, protection against freezing is thereby also ensured here.

DETAILED DESCRIPTION OF THE DRAWINGS

The invention is now explained in more detail below with reference to a drawing illustrating just one preferred exemplary embodiment.

Figure 1:
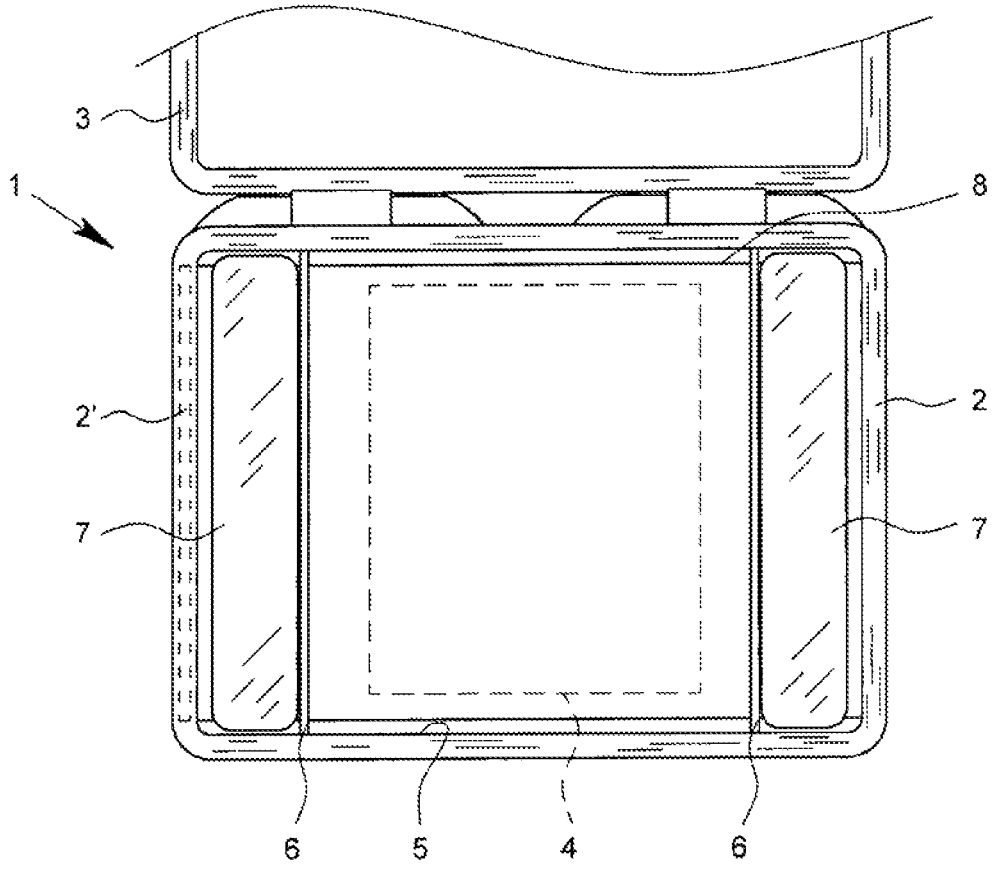
FIG. 1 shows a preferred container for use in preconditioning of latent heat storage elements.

The container 1 illustrated in FIG. 1 of the drawing has a container wall 2 in which vacuum insulation panels 2' are located as thermal insulation. The vacuum insulation panels 2' of the exemplary embodiment illustrated are arranged concealed in the walls 2 and are therefore indicated only by dashed lines. However, reference should be made to the prior art mentioned in this respect.

The container 1 is closeable by a lid 3 which is hinged on the container 1 at the top, wherein, in the single figure of the drawing, the lid 3 is illustrated in an open position. The lid 3 also has a heat-insulating installation in the form of a vacuum insulation panel or a plurality of vacuum insulation panels.

In order to be able to transport temperature-sensitive items 4 in the interior of the container 1, there is a receiving space 5 in the interior of the container 1. The manner in which corresponding items 4 can be located in the receiving space 5 is indicated by dashed lines in the single figure of the drawing. The item 4 can be a correspondingly temperature-sensitive product, for example an organ which is intended for transplant and which is optionally arranged for its part in a storage container 4.

Thin walls 6, for example in the form of a thin inner wall made from plastic, are seen on the right and left of the receiving space 5. However, any type of sheet metal or cardboard or a corresponding laminated material plate could also be suitable here. By means of the wall 6, a narrow space is created in each case toward the container wall 2. A latent heat storage element 7 is located here in each of these two spaces. This latent heat storage element 7 (PCM) is similar to a cooling battery. The characteristics of a latent neat storage element 7 have been explained by way of introduction in the description.

In addition, it is preferably the case that there is no connection between the receiving space 5 and the latent heat storage element 7 except for the heat-transmitting connection through the wall 6.

The arrangement of the latent neat storage element 7 in the container 1 is not restricted to the side walls. In principle, the latent heat storage element 7 could also be arranged in the base and/or in the lid 3, or, for example, also just on one side.

The illustrated and preferred exemplary embodiment is furthermore distinguished in that the base of the container 1 is likewise covered on the inside by a latent heat storage element 8. The latter extends from the left to the right between the two latent heat storage elements 7 and forms the base of the receiving space 5. This results in a comprehensive, uniform temperature control of the receiving space 5 and thermal coupling of the lateral latent heat storage element 7. However, this is only a preferred, not necessary, refinement for the container 1 according to the invention.

According to the invention, within the scope of the exemplary embodiment which is described here, and is particularly preferred, but should be understood as not limiting, if is of importance now the latent heat storage elements 7 are preconditioned in the interior of the container 1. In order to understand this better, FIG. 2 of the drawing will be used.

Figure 2:
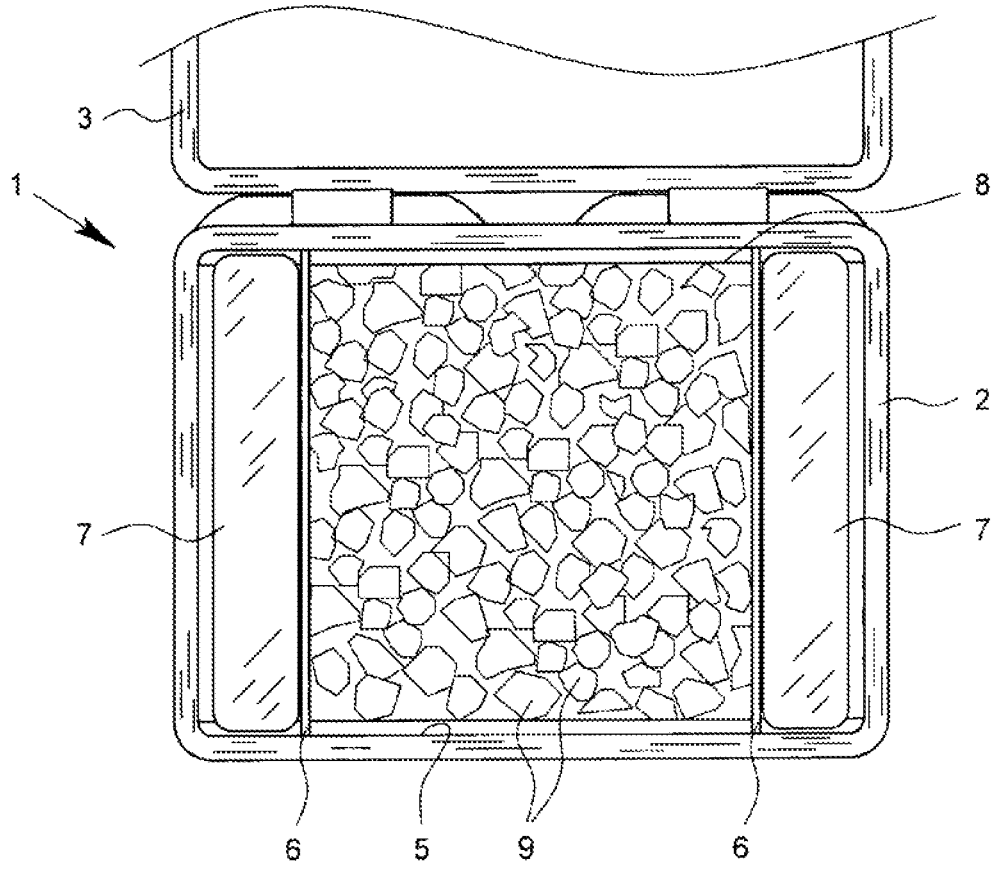
FIG. 2 shows the container prepared for receiving a temperature-sensitive item in accordance with the present disclosure.

In FIG. 2 of the drawing, the temperature-sensitive item 4, which is indicated by dashed lines in FIG. 1 of the drawing, and the storage container 4 of the item are omitted. FIG. 2 shows the situation in which the container 1 is prepared for subsequently receiving a temperature-sensitive item 4.

As explained above, this is done by the fact that the user pours a correspondingly appropriate quantity of a coolant 9, water ice in the preferred example, into the receiving space 5. This should preferably be "crushed ice" so that it is distributed as widely as possible. The coolant 9 which is located in the receiving space 5 and is in the form of "crushed ice" in this exemplary embodiment is seen indicated in FIG. 2. The lid 3 of the container 1 is still open here.

The lid 3 of the container 1 is closed. A mixing temperature defined by the initial temperature of the latent heat storage element 7, the inner walls of the container 1 and the temperature of the coolant 9, i.e. in particular of the water ice, is formed in the interior of the container 1. After a while, the latent heat storage elements 7 have reached the target temperature thereof. The remaining cold water is then poured away from the receiving space 5, the receiving space 5 is dried out and the container 1 is ready to transport the item 4 (FIG. 1).

The statements in the general part of the description and in the claims apply in general to all of the variants of the method according to the invention. The operating principle of the invention basically consists in that because of the latent heat storage element 7 heat does not flow out of the receiving space 5 of the container 1, but rather heat is supplied to a certain extent to said interior by the latent heat storage elements 7 and 8. As a result, a somewhat higher temperature is set in the receiving space 5 of the container 1 than would be predetermined per se by the coolant 9 located there. If the coolant is water ice, with this methodology, the temperature in the interior for items 4 inserted later or isochronously can be kept in the desired manner just above the limiting temperature, in particular above the freezing point.

Reference should be made in detail to the various possible method steps which have been explained in the general part of the description.

The invention claimed is:

1. A method for preconditioning at least one latent heat storage element which is arranged in a thermally insulated, closed container having a receiving space for items to be transported, wherein the latent heat storage element has a defined target temperature, the method comprising:

using an initial temperature of the latent heat storage element, a thermal capacity of the latent heat storage element and the target temperature of the latent heat storage element to calculate a mass of a coolant appropriate for the target temperature of the latent heat storage element that has to be placed into the receiving space so that the latent heat storage element reaches the target temperature thereof;

placing the mass of coolant calculated in this manner into the receiving space; and wherein the latent heat storage element located in the container reaches the target temperature thereof when the cooling in the receiving space has substantially melted.

2. The method as claimed in claim 1, wherein the coolant is removed from the receiving space once the target temperature of the latent heat storage element has been reached.

3. The method as claimed in claim 1, wherein, after the coolant is placed into the receiving space of the container, the container is closed.

4. The method as claimed in claim 1, wherein the coolant is placed into the receiving space of the container in a separate, closed vessel.

5. The method as claimed in claim 1, wherein the latent heat storage element has a target temperature greater than 0° C.

6. The method as claimed in claim 5, wherein ice is used as the coolant.

7. The method as claimed in claim 1, further comprising placing the items to be transported into the receiving space and transporting the items in the closed container.

8. A method for preconditioning at least one latent heat storage element to be used in a thermally insulated closed container having a receiving space for items to be transported, wherein said latent heat storage element has an initial temperature, a particular thermal capacity, and a defined target temperature, the method comprising:

using the initial temperature of said latent heat storage element, the thermal capacity of said latent heat storage element, and the target temperature of said latent heat storage element to calculate a mass of a coolant appropriate for the target temperature of said latent heat storage element, placing said latent heat storage element in the receiving space of said thermally insulated container, placing said mass of coolant as calculated before into the receiving space of said thermally insulated container, closing said thermally insulated container, and wherein the latent heat storage element located in the container reaches the target temperature thereof when the cooling in the receiving space has substantially melted.

9. The method as claimed in claim 8, wherein the coolant is removed from the receiving space once the target temperature of the latent heat storage element has been reached.

* * * * *